United States Patent [19]

Kanda et al.

[11] 4,184,317

[45] Jan. 22, 1980

[54] WATCH MOVEMENT MOUNTING STRUCTURE

[75] Inventors: Nobuyuki Kanda, Tokorozawa; Yasuo Kamiyama, Sayama, both of Japan

[73] Assignee: Citizen Watch Co., Ltd., Japan

[21] Appl. No.: 863,413

[22] Filed: Dec. 22, 1977

[30] Foreign Application Priority Data

Dec. 27, 1976 [JP] Japan ..... 51-176709[U]
Jun. 24, 1977 [JP] Japan ..... 52-82452[U]

[51] Int. Cl.[2] ..... G04B 37/08; G04B 37/04

[52] U.S. Cl. ..... 58/90 R; 58/94

[58] Field of Search ..... 58/53, 88 R, 88 C, 90 R, 58/90 B, 91, 92, 94, 59

[56] References Cited

U.S. PATENT DOCUMENTS

| | | | |
|---|---|---|---|
| 3,479,771 | 11/1969 | Steimann | 58/90 R |
| 3,492,810 | 2/1970 | Levrat | 58/90 R |
| 3,668,865 | 6/1972 | Hirabayashi | 58/127 B |
| 3,817,025 | 6/1974 | Siegrist | 58/90 R |
| 4,059,957 | 11/1977 | Monnet | 58/90 R |

FOREIGN PATENT DOCUMENTS

| | | | |
|---|---|---|---|
| 2651565 | 5/1977 | Fed. Rep. of Germany | 58/90 R |
| 282450 | 8/1952 | Switzerland | 58/90 A |
| 562466 | 5/1975 | Switzerland | 58/88 R |

*Primary Examiner*—Vit W. Miska

[57] ABSTRACT

A watch movement mounting structure for fixing a watch movement in a watch case having a case body including a radially extending annular shoulder and a radially inwardly extending annular projection contiguous with the annular shoulder, which structure comprises a flexible annular support member including an annular wall adapted to rest on the annular shoulder of said case body, a plurality of circumferentially spaced, inwardly directed flange segments each of which extends upwardly of the annular wall to retain the watch movement, and a plurality of circumferentially spaced, outwardly directed flange segments each of which extends downwardly of the annular wall and adapted to engage the annular projection of the case body, whereby said watch movement is fixed in place in said case body and the axial displacement of the watch movement is prevented.

9 Claims, 9 Drawing Figures

WATCH MOVEMENT MOUNTING STRUCTURE

This invention relates to a watch case and, more particularly, to a mounting structure for fixing a watch movement within the watch case.

A great number of different solutions have already been proposed for the fixation of a watch movement to the body of a watch case. One of these solutions is to provide a case ring which is fixed in place by a sealing ring compressed between a downwardly extending projection of a bezel and the body of the watch case. The case ring is formed with an inwardly directed annular flange, to which the watch movement is fixed by means of screws. The use of these screws makes it difficult to assemble or disassemble the watch movement to and from the body of the watch case. Another problem is encountered with this prior art in that the bezel cannot be fixedly held in place especially when the watch case is subjected to impact shocks and tends to move apart from the case body when the impact shocks are great. Thus, the watch movement is liable to be damaged due to these causes. To solve these problems, it has been proposed to have the body of the watch case equipped with a support ring which is fixedly held in place by a back cover screwed to the case body. In this expedient, the support ring has an inwardly directed annular projection on which the watch movement is placed and retained in place by the action of a dial. The dial presses the watch movement by a compression ring engaging an inner wall of a sealing ring and a bottom wall of a glass plate. A tension ring is provided around an outer periphery of the sealing ring, which is pressed tightly against the glass plate and the compression spring. With this structure, since the dial has a small thickness, it is difficult to assemble the compression ring and the glass plate to the watch case so as to suitably press the dial against the watch movement. Accordingly, attempts have been made to mount the watch movement directly onto the body of the watch case with the use of a dial ring against which a sealing ring is compressed by a tension ring and a case band. Due to a large number of these component parts, it requires a longer time to assemble the watch case. Another drawback is that, since the watch movement is directly fixed to the case body, the watch movement is liable to be affected by impact shocks. In addition, if the dial rings moves apart from the case body by some reasons or the other, the watch movement is unstable so that manipulation of the watch case needs great attention.

It is, therefore, an object of the present invention to provide a watch movement mounting structure which can overcomes the shortcomings encountered in prior art.

It is another object of the present invention to provide a watch movement mounting structure which makes it easy to assemble a watch movement to the body of a watch case.

It is another object of the present invention to provide a watch movement mounting structure incorporating a watch movement support member made of a flexible material by which the watch movement is fixedly secured to the body of a watch case but impact shocks to be applied to the watch movement from outside may be alleviated to reduce the degree of damages to the watch movement.

It is still another object of the present invention to provide a watch movement mounting structure which is made by injection molding a plastic material.

These and other objects, features and advantages of the present invention will become more apparent from the following description when taken in conjunction with the accompanying drawings, in which.

Figure 1:
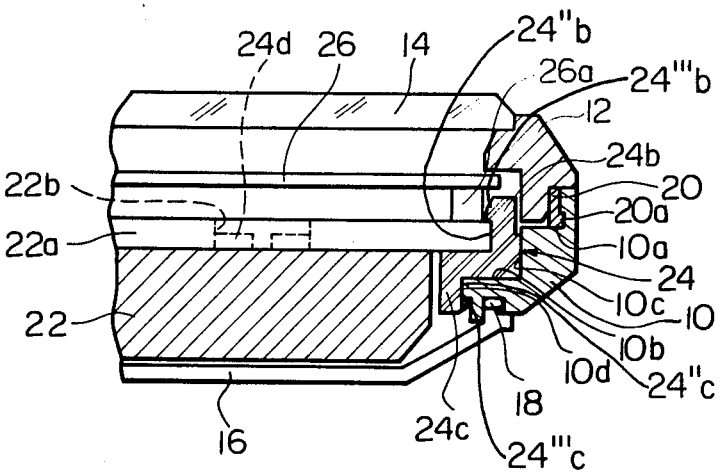
FIG. 1 is a fragmentary sectional view of a preferred embodiment of a watch movement mounting structure according to the present invention.

Referring now to FIG. 1, there is shown in cross section a watch case incorporating a watch movement mounting structure according to the present invention. The watch case comprises a case body 10, a bezel 12 supported by the case body 10 and retaining a glass plate 14, and a back cover 16 screwed to the case body 10 to provide a water-tight sealing effect by means of a sealing ring 18. A sealing ring 20 is made of a relatively hard, flexible material such as polytetrafluoroethylene known as a "Teflon" and includes an axially extending annular body and a radially outwardly directed annular projection formed at a lower end of the annular body. The sealing ring 20 thus formed is compressed between the bezel 12 and the case body 10 such that the radially outwardly directed annular projection **20*a* engages a corresponding annular recess 10*a* of the case body 10 whereby the axial movement of the bezel 12 relative to the case body 10 is effectively prevented. The watch case also comprises a watch movement 22 which is fixedly supported in the case body 10 by a watch movement mounting structure. The case body 10 has an axial bore 10*c* larger in diameter than the watch movement 22, a radially extending annular shoulder 10*b*, and a radially inwardly directed annular projection 10*d* contiguous with the annular shoulder 10*b*. The inner diameter of the annular projection 10*d* is selected to be smaller than that of the watch movement 22**.

Figure 2:
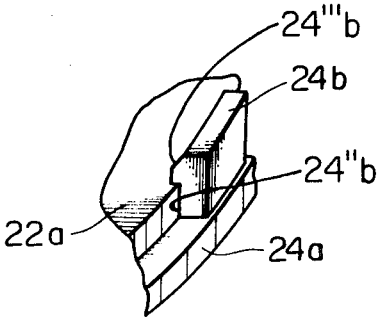
FIG. 2 is a fragmentary perspective view of a part of the watch movement mounting structure shown in FIG. 1.
Figure 3:
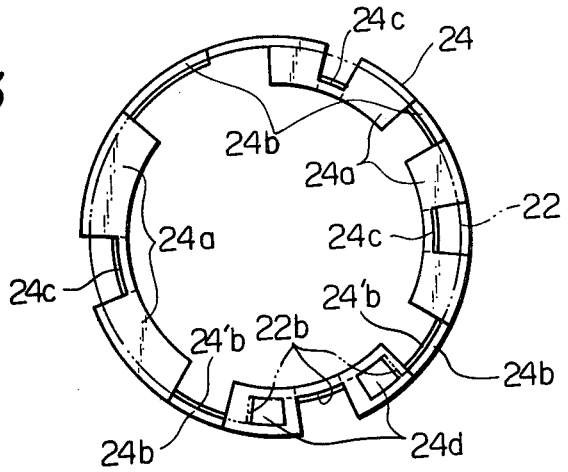
FIG. 3 is a plan view of an annular support member forming part of the mounting structure shown in FIG. 1.
Figure 4:
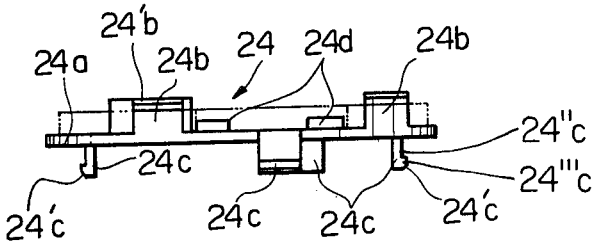
FIG. 4 is a side view of the annular support member shown in FIG. 3.

As shown in FIGS. 2, 3 and 4, the watch movement mounting structure 24 comprises an annular support member made of a relatively hard, flexible material to support the watch movement 22 in the case body 10 so as to absorb impact shocks to be applied to the watch movement 22 from outside. The annular support member 24 comprises a radially extending annular wall **24*a* with its upper surface engaging the bottom wall of a flange 22*a* of the watch movement and its lower surface engaging the annular shoulder 10*b* of the case body, a plurality of circumferentially spaced, inwardly directed flange segments 24b which upwardly extend from the annular wall 24a, and a plurality of circumferentially spaced, outwardly directed flange segments 24c which downwardly extend from the lower surface of the annular wall 24a. Each of the radially inwardly directed flange segments 24b has a radially inwardly facing recess 24''b with which the annular flange 22a of the watch movement 22 engages, and a hook 24'''b provided adjacent the recess 24''c, with the hook 24'''b engaging an upper surface of the annular flange 22a of the watch movement 22. Likewise, each of the radially outwardly directed flange segments 24c has a radially outwardly facing recess 24''c with which the annular projection 10d of the case body 10 engages, and a hook 24'''c engaging a lower surface of the annular projection 10d of the case body 10. The annular wall 24a is not a complete annular shape but is segmented. The flange segments 24c are located at a radially inward position of the annular wall 24a so as to allow the lower portion of the case body 10 to be slanted together with the back cover 16 as shown in FIG. 1**, to let the thickness of the watch case to appear thin.

The watch movement is held axially against the annular wall of the annular support member 24 by the inwardly projecting flange segment 24b. Insertion of the watch movement 22 into the annular support member 24 is facilitated by the presence of a slanted surface 24'b. To prevent rotation of the watch movement 22 relative to the annular support member 24, the annular support member 24 also has one or more upwardly extending projection 24d, which engages a notch 22b of the watch movement 22.

When it is desired to assemble the watch movement 22 into the watch case, the watch movement 22 is inserted into the annular support member 24 and held thereby by the snap action of the flange segments 24b. Then, the annular support member 24 holding the watch movement 22 is inserted through the axial bore 10c of the case body 10 until the downwardly extending flange segments 24c engages the radially extending annular projection 10d of the case body 10 and, thus, the watch movement 22 is held in place. Under this circumstance, since the upper flange segments 24b of the annular support member 24 engages the flange 22a of the watch movement and the lower flange segments 24c of the annular support member 24 engage the annular projection of the case body 10, the axial displacement of the watch movement 22 is prevented. Next, the bezel 12 to which the glass plate 14 is already fixed is inserted into and fixed by the case body 10 by means of the sealing 20. Thereafter, the back cover 16 is fixed to the case body 10 by means of the seal 18.

When it is desired to remove the watch movement 22 from the watch case, the back cover 16 and the bezel 12 are initially removed from the case body 10 and, thereafter, the watch movement 22 is removed from the case body 10 by pressing the lower flange segments 24c inward with the use of suitable means.

Figure 5:
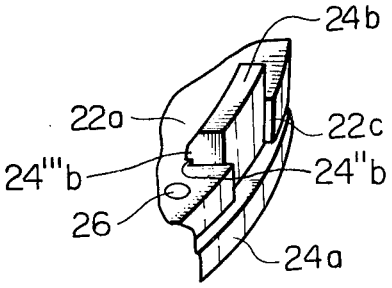
FIG. 5 is a fragmentary perspective view of a modification of the structure shown in FIG. 2.
Figure 6:
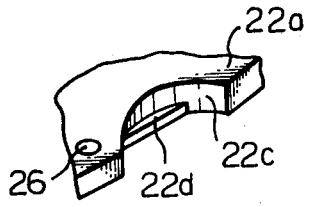
FIG. 6 is a fragmentary perspective view of another modification of the structure shown in FIG. 2.

FIG. 5 shows a fragmentary view showing a modified form of the watch movement. In this modification, the flange 22a of the watch movement 22 has a rectangular cutout 22c to which the flange segment 24b engages. Indicated at 26 in FIG. 5 is a hole to which a leg 26a of a time dial 26 is fitted. In FIG. 5, although the cutout 22c is shown as having a rectangular shape, it may be of a rounded shape as shown in FIG. 6. In this case, the cutout 22c is provided with an engagement portion 22d with which the flange segment of the annular support member 24 engages.

Figure 7:
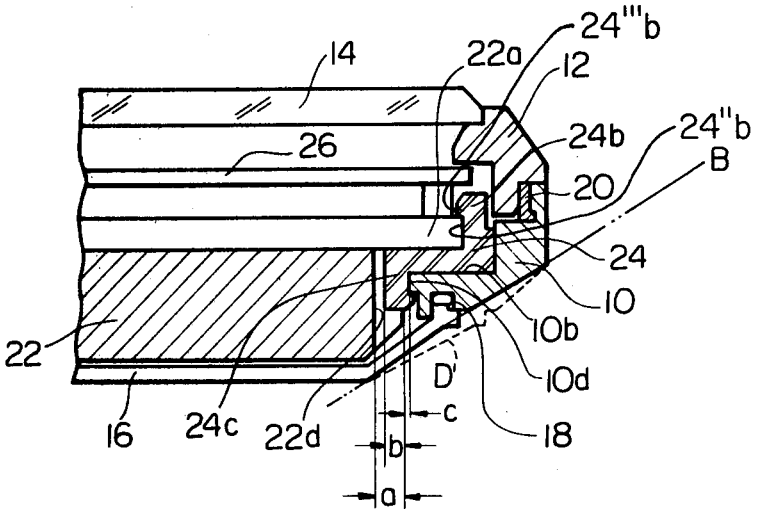
FIG. 7 is a fragmentary cross sectional view of another preferred embodiment of a watch movement mounting structure according to the present invention.
Figure 8:
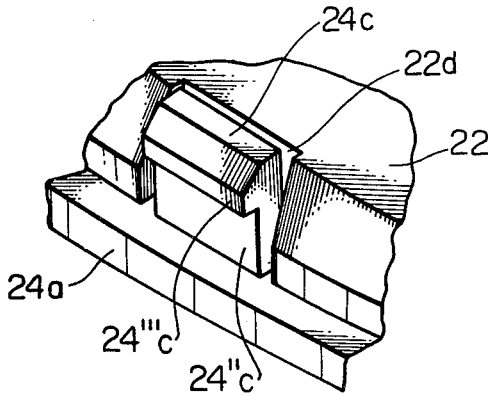
FIG. 8 is a fragmentary perspective view of a part of the mounting structure shown in FIG. 7.

Another preferred embodiment of the watch movement mounting structure is shown in FIGS. 7 and 8, in which like or corresponding components parts are designated by the same reference numerals as those used in FIG. 1. In this illustrated embodiment, the watch movement 22 has its lower portion formed with circumferentially spaced cutouts 22d. Each cutout 22d has a depth a greater than the thickness b of the flange segment 24c and the difference c between the outer periphery of the lower portion of the watch movement 22 and the inner diameter of the annular projection 10d of the case body 10 can be made as small as possible. This makes it possible to reduce the outer diameter of the back cover 16 so that the joining portion between the back cover and the case body 10 can be provided inward. Therefore, the case body 10 and the back cover 16 may have a sloping surface as shown by a phantom line B in FIG. 7. It is thus readily seen that the watch case of FIG. 7 has a thickness less than that of FIG. 1 as shown by a dotted line D.

Figure 9:
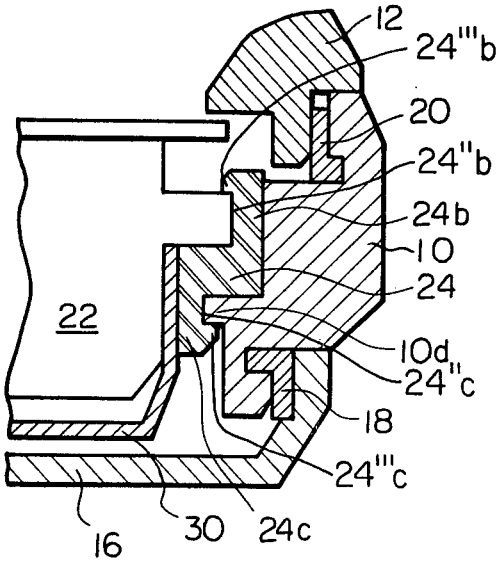
FIG. 9 is a fragmentary cross sectional view of a watch movement mounting structure according to the present invention.

FIG. 9 shows still another preferred embodiment of the watch movement mounting structure according to the present invention. In this illustrated embodiment, a backing member 30 is disposed between the lower portion of the watch movement 22 and the inner wall of each lower flange segment 24c. The backing member 30 may be made of any suitable material such as plastics. With this arrangement, the flange segments 24c are prevented for disengaging the annular projection of the case body 10 after the watch case has been assembled.

It should now be understood from the foregoing description that since a watch case has a watch movement held in place by means of a watch movement mounting structure without the use of fastening means such as screws, easy assembling and disassembling can be obtained and the number of component parts can be reduced to increase the internal spacing of the watch case.

It should further be noted that in accordance with the present invention the appearance of a watch case can be remarkably improved because a case body of the watch case can be made thinner due to its inherent construction and arrangement previously described.

While the present invention has been shown and described with reference to particular embodiments by way of example, it should be born in mind that various other changes or modification can be made without departing from the scope of the present invention. For example, while the watch case has been shown and described as having a case body and a back cover separately formed from the case body to facilitate the replacement of a battery, the watch case may comprises a case body made of a single metallic piece serving as a case band and a back cover. The watch movement mounting structure of the present invention may also be applied to a watch case having such a single piece of the case band and the back cover. In addition, although the watch movement has been described as having a flange, it should be noted that the flange may be a base plate on which various timepiece components are mounted.

What is claimed is:

1. A watch movement mounting structure for fixing a watch movement having an annular flange in a watch case having a case body including a radially extending annular shoulder and a radially inwardly extending annular projection contiguous with the annular shoulder, comprising:

a flexible annular support member including an annular wall adapted to rest on the annular shoulder of said body, a plurality of circumferentially spaced, inwardly directed flange segments each of which extends upwardly of the annular wall to retain the watch movement, and a plurality of circumferentially spaced, outwardly directed flange segments each of which extends downwardly of the annular wall and adapted to engage the annular projection of the case body, whereby said watch movement is fixed in place in said case body and the axial displacement of the watch movement is prevented;

each of said plurality of circumferentially spaced, inwardly directed flange segments including a radially inwardly facing recess adapted to engage the annular flange of said watch movement, and a hook portion formed adjacent said recess and engaging an upper surface of the annular flange of said watch movement; and each of said plurality of circumferentially spaced, outwardly directed flange segments including a radially outwardly facing recess adapted to engage the annular projection of said case body, and a hook portion formed adjacent said recess and engaging a lower surface of said annular projection.

2. A watch movement mounting structure according to claim 1, in which said flexible annular support member is made of a plastic material.

3. A watch movement mounting structure according to claim 1, in which said watch movement has a flange having a cutout formed at an outer periphery of the flange to receive each of said first flange segments.

4. A watch movement mounting structure according to claim 1, in which said watch movement has its lower portion formed with a cutout with which each of said second flange segments engages.

5. A watch movement mounting structure according to claim 1, in which said watch movement has a notch formed at its outer periphery, and said annular support member also includes upward projections formed on said annular wall, said upward projection engaging said notch for thereby preventing said watch movement from rotating relative to said case body.

6. In a watch case having a watch movement including an annular flange, the improvement comprising:

a case body having an axial bore, a radially extending annular shoulder extending from said axial bore, and a radially inwardly directed annular projection contiguous with said annular shoulder;

a bezel supported by said case body;

a glass plate retained by said bezel; and a flexible annular support member made of a plastic material and disposed in the axial bore of said case body, said annular member including an annular wall engaging the annular shoulder of said case body, a plurality of circumferentially spaced, inwardly directed flange segments each of which includes a radially inwardly facing recess engaging the annular flange of said watch movement, and a hook portion engaging an upper surface of the annular flange of said watch movement, and a plurality of circumferentially spaced, outwardly directed flange segments each of which includes a radially outwardly facing recess engaging said annular projection of said case body, and a hook portion engaging a lower surface of said annular projection of said case body.

7. The improvement according to claim 6, in which said annular flange of said watch movement has a cutout formed at an outer periphery of said annular flange to receive each of said first flange segments.

8. The improvement according to claim 6, in which said watch movement has its lower portion formed with a cutout with which each of said second flange segments engages.

9. The improvement according to claim 6, in which said watch movement has a notch formed at its outer periphery, and said annular support member also includes upward projections formed on said annular wall, said upward projection engaging said notch for thereby preventing said watch movement from rotating relative to said case body.

* * * * *